US007614106B2

(12) United States Patent
Oh et al.

(10) Patent No.: US 7,614,106 B2
(45) Date of Patent: Nov. 10, 2009

(54) WASHING MACHINE AND CONTROL METHOD THEREOF

(75) Inventors: Soo Young Oh, Seoul (KR); Si Moon Jeon, Seoul (KR); Kyung Chul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 646 days.

(21) Appl. No.: 11/263,971

(22) Filed: Nov. 2, 2005

(65) Prior Publication Data

US 2006/0191077 A1 Aug. 31, 2006

(30) Foreign Application Priority Data

Feb. 25, 2005 (KR) ..... 10-2005-0015824

(51) Int. Cl.
*D06F 33/02* (2006.01)

(52) U.S. Cl. ..... 8/158; 68/12.21; 68/15

(58) Field of Classification Search ..... 68/15, 68/207

See application file for complete search history.

(56) References Cited

U.S. PATENT DOCUMENTS

| | | | | |
|---|---|---|---|---|
| 4,484,515 | A * | 11/1984 | Illy | 99/282 |
| 4,526,136 | A * | 7/1985 | Boland et al. | 122/451.1 |
| 4,948,947 | A * | 8/1990 | Kang | 392/386 |
| 5,042,179 | A * | 8/1991 | van der Meer | 38/77.83 |
| 5,561,880 | A * | 10/1996 | Allen et al. | 8/149.3 |
| 5,666,910 | A * | 9/1997 | George et al. | 122/40 |

FOREIGN PATENT DOCUMENTS

| | | | |
|---|---|---|---|
| EP | 1 469 120 | A1 | 10/2004 |
| EP | 1 544 345 | A2 | 6/2005 |
| GB | 2 191 851 | * | 12/1987 |
| JP | 01-105494 | * | 4/1989 |
| JP | 01-320019 | * | 12/1989 |
| JP | 4-158896 | A | 6/1992 |
| JP | 05-010503 | * | 1/1993 |
| JP | 09-084858 | * | 3/1997 |
| JP | 02-221878 | * | 9/1998 |
| JP | 10-339404 | * | 12/1998 |
| JP | 2003-085256 | * | 3/2002 |
| JP | 2003-93775 | A | 4/2003 |

OTHER PUBLICATIONS

European Patent Office 0 316 496 Nov. 1987.*

* cited by examiner

*Primary Examiner*—Frankie L Stinson
(74) *Attorney, Agent, or Firm*—Birch, Stewart, Kolasch & Birch, LLP

(57) ABSTRACT

A washing machine and control method thereof are disclosed, by which water waste is reduced and by which an error or malfunction of the washing machine is detected and by which the detected error or malfunction of the washing machine is notified to a user. The present invention includes the steps of measuring an initial temperature of water supplied within a steam generator for providing steam to a drum, heating the water within the steam generator for a set time, measuring a temperature of the heated water within the steam generator, calculating a difference between the heated water temperature and the initial water temperature, and deciding a presence or non-presence of abnormality of the steam generator based on the calculated temperature difference.

15 Claims, 8 Drawing Sheets

WASHING MACHINE AND CONTROL METHOD THEREOF

This application claims the benefit of the Korean Patent Application No. P2005-0015824, filed on Feb. 25, 2005, which is hereby incorporated by reference as if fully set forth herein.

BACKGROUND OF THE INVENTION

1. Field of the Invention

The present invention relates to a washing machine, and more particularly, to a washing machine and control method thereof. Although the present invention is suitable for a wide scope of applications, it is particularly suitable for using steam.

2. Discussion of the Related Art

Generally, a washing machine is a representative home appliance that washes a laundry using water. And, the washing machine can be classified into a tip loading type and a front loading type according to a position of a laundry entrance.

The top loading type washing machine generally consists of a tub standing upright to accommodate a laundry therein, a pulsator rotatably provided within the tub to ash the laundry, and a lid provided to an upper side of the washing machine to close/open the tub. The top loading type washing machine performs washing in a manner of utilizing a friction force between the laundry and a water current generated from rotating the pulsator in right-to-left directions. And, the top loading type washing machine is advantageous in a short wash time, a large wash capacity and a low price. Yet, the top loading type washing machine having the pulsator is disadvantageous in a laundry raveling occurrence and a relatively considerable damage caused to the laundry.

The front loading type washing machine generally consists of a tube ad drum horizontally provided to accommodate a laundry therein, a plurality of lifters provided to an inside of the drum to lift the laundry up and down while the drum is rotating, and a door provided to a front side of the washing machine to close/open the drum. In the front loading type washing machine, the drum, within which water, detergent and laundry are put, is rotated to wash the laundry. And, the front loading type washing machine causes less damage to the laundry and prevents the laundry from being raveled.

However, these washing machines need considerably amount of water to perform a washing process, whereby water is wasted in performing the washing process.

SUMMARY OF THE INVENTION

Accordingly, the present invention is directed to a washing machine and control method thereof that substantially obviate one or more problems due to limitations and disadvantages of the related art.

An object of the present invention is to provide a washing machine and control method thereof, by which water waste is reduced and by which wash efficiency is enhanced.

Another object of the present invention is to provide a washing machine and control method thereof, in which an error or malfunction of the washing machine is detected and by which the detected error or malfunction of the washing machine is notified to a user.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method of controlling a washing machine according to the present invention includes the steps of measuring an initial temperature of water supplied within a steam generator for providing steam to a drum, heating the water within the steam generator for a set time, measuring a temperature of the heated water within the steam generator, calculating a difference between the heated water temperature and the initial water temperature, and deciding a presence or non-presence of abnormality of the steam generator based on the calculated temperature difference.

Preferably, the deciding step includes the steps of comparing the calculated temperature difference to at least one or more reference temperatures and deciding the presence or non-presence of the abnormality of the steam generator according to a result of the comparing step.

More preferably, if the calculated temperature difference is smaller than a minimum reference temperature or greater than a maximum reference temperature, it is decided that the steam generator is abnormal.

More preferably, if the calculated temperature difference is greater than a minimum reference temperature and smaller than a maximum reference temperature, it is decided that the steam generator is normal.

Preferably, the method further includes the step of outputting a message or an alarming sound to notify the abnormality of the steam generator if the presence of the abnormality of the steam generator is decided.

Preferably, the method further includes the step of changing a washing course or cycle if the presence of the abnormality of the steam generator is decided.

Preferably, the method further includes the step of deciding whether to heat the water within the steam generator based on the measured initial temperature.

In another aspect of the present invention, a washing machine includes a drum, a steam generator providing steam to the drum, the steam generator having a heater heating water within the steam generator and a temperature sensor measuring a temperature of the water, and a control unit calculating a temperature difference between an initial temperature of the water supplied within the steam generator and a temperature of the heated water to decide a presence or non-presence of abnormality of the steam generator based on the calculated temperature difference.

Preferably, the control unit compares the calculated temperature difference to at least one or more reference temperatures and decides the presence or non-presence of the abnormality of the steam generator according to a corresponding comparison result.

More preferably, if the calculated temperature difference is smaller than a minimum reference temperature or greater than a maximum reference temperature, the control unit decides that the steam generator is abnormal.

More preferably, if the calculated temperature difference is greater than a minimum reference temperature and smaller than a maximum reference temperature, the control unit decides that the steam generator is normal.

Preferably, the control unit selects either a steam mode for using the steam or a non-steam mode for not using the steam according to the initial temperature.

In another aspect of the present invention, a method of controlling a washing machine includes the steps of measuring an initial inner temperature of a steam generator for providing steam to a drum, supplying water within the steam generator, heating the water within the steam generator for a set time, measuring a heated inner temperature of the steam generator, calculating a difference between the heated inner temperature and the initial inner temperature, and deciding a presence or non-presence of the steam generator based on the calculated temperature difference.

Preferably, the deciding step includes the steps of comparing the calculated temperature difference to at least one or more reference temperatures and deciding the presence or non-presence of the abnormality of the steam generator according to a result of the comparing step.

More preferably, if the calculated temperature difference is smaller than a minimum reference temperature or greater than a maximum reference temperature, it is decided that the steam generator is abnormal.

More preferably, if the calculated temperature difference is greater than a minimum reference temperature and smaller than a maximum reference temperature, it is decided that the steam generator is normal.

In another aspect of the present invention, a washing machine includes a drum, a steam generator providing steam to the drum, the steam generator having a heater heating water within the steam generator and a temperature sensor measuring an inner temperature of the steam generator, and a control unit calculating a temperature difference between an initial inner temperature prior to supplying the water within the steam generator and an inner temperature heated for a preset time after supplying the water within the steam generator to decide a presence or non-presence of abnormality of the steam generator based on the calculated temperature difference.

Preferably, the control unit compares the calculated temperature difference to at least one or more reference temperatures and decides the presence or non-presence of the abnormality of the steam generator according to a corresponding comparison result.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
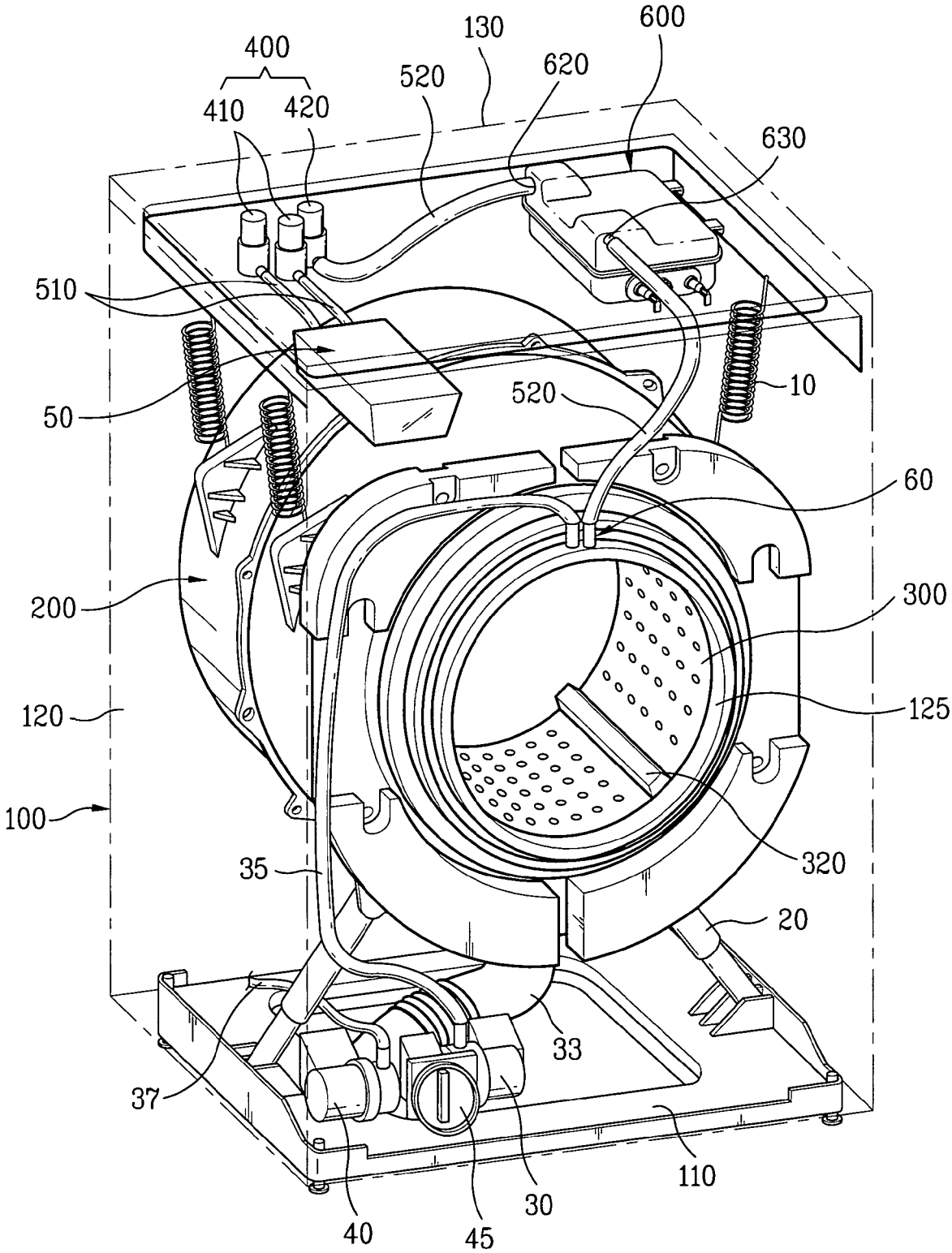
FIG. 1 is a perspective diagram of a washing machine according to the present invention.
Figure 2:
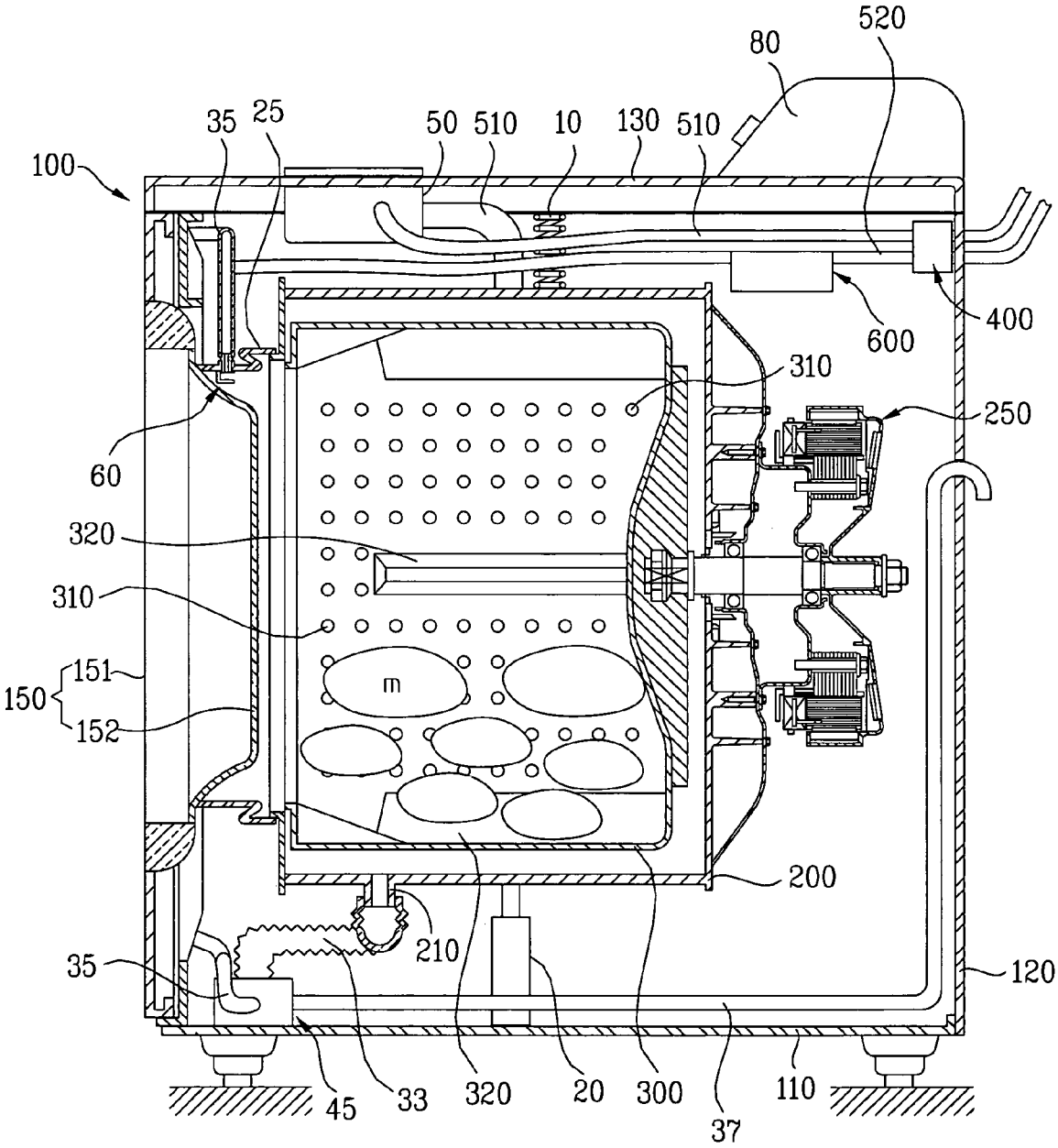
FIG. 2 is a cross-sectional diagram of the washing machine in FIG. 1.

FIG. 1 is a perspective diagram of a washing machine according to the present invention and FIG. 2 is a cross-sectional diagram of the washing machine in FIG. 1, in which a front loading drum type washing machine is exemplarily shown. The front loading type washing machine includes a tub 200 provided within a case to accommodate water therein and a drum 300 rotatably provided in a horizontal direction within the tub 200 to accommodate a laundry therein. The present invention is not limited to the front loading drum type washing machine but is applicable to a top loading type pulsator washing machine having a tub and drum provided in a vertical direction in the same way.

Referring to FIG. 1 and FIG. 2, a case 100 of a washing machine includes a base 110, a wall 120 and a top plate 130.

The base configures a bottom side of the case 100 and a damper 20 is provided on to the base 110 to support a tub 200 that will be explained later. The wall 120 is placed upright onto the base 110 to provide a space for installing the tub 200 therein. The upright wall configures a front, rear and both lateral sides of the case 100. And, the top plate 130 is placed over an opening of the wall 120 to seal the inner space of the case 100 enclosed by the wall 120 and the base 110.

A control panel 80 for a user to operate the washing machine is provided to an upper front side of the wall 120 or an upper side of the top plate 130. And, springs 10 are connected to an inside of the wall 120 or the top plate 130 so that the tub 200 can be suspended by the springs 10. An entrance hole 125 is provided to one face of the wall 120, e.g., to the front side of the wall 120 so that a laundry m can be put or can be pulled out through the entrance hole 125. The entrance hole 125 is closed or opened by a door 150 hinged to the front side of the wall 120. The door 150 includes a door frame 151 and a door glass 155. The door glass 155, as shown in FIG. 2, is assembled to a hole formed on a central part of the door frame 151. Hence, a user can observe an inside of the washing machine, and more particularly, an inside of a drum 300 that will be explained later via the door glass 155.

The tub 200 is provided within the inner space of the case 100. As mentioned in the foregoing description, the tub 200 is suspended within the inner space by the springs 10 and is supported by the damper 20. The tub 200 is installed so that its open front side can oppose the entrance hole 125 of the wall 120. Hence, the above installed tub 200 can store the supplied water therein.

The drum 300 is rotatably provided within the tub 200. For this configuration, a motor 250 is provided within the case 100 to rotate the drum 300. In FIG. 2, a shaft of the motor 250 is directly joined to the drum 300 for example. In this case, the shaft penetrates the tub 200 and is then fixed to a backside of the drum 300. Alternatively, the motor 250 can be installed to indirectly rotate the drum 300. In this case, the drum 300 and the motor 250 can be connected to each other via a power transmission member such as a belt and the like.

A multitude of perforated holes 310, as shown in FIG. 2, are formed on a circumference of the drum 300. Hence, the water stored within the tub 200 can enter or escape from the inner space of the drum 300 via a multitude of the perforated holes 310. And, a plurality of lifters 320, as shown in FIG. 1 and FIG. 2, are projected from an inner circumference of the drum 300. A plurality of the lifters 320 lift the laundry m upward to fall while the drum 300 is rotating.

A gasket 25, as shown in FIG. 2, is provided between the tub 200 and a front side of the wall 120. The gasket 25 prevents the water and laundry m from escaping from the tub 200 to the inner space of the case 100. Meanwhile, a nozzle assembly 60, as shown in FIG. 2, is installed to penetrate an upper part of the gasket 25.

A water supply valve 400, as shown in FIG. 1 and FIG. 2, is provided to one side of the case 100, e.g., to a rear side of the wall 120. The water supply valve 400 is connected to an external water supply source, e.g., to a tap to switch water supplied from the water supply source. In the washing machine according to the present invention, the water supply valve 400 includes at least two valves, i.e., first and second valves 410 and 420.

The first valve 410 is connected to the tub 200 via a first hose, e.g., via a water supply hose 510. The second valve 420 is connected to the tub 200 via a second hose, e.g., via a supply hose 520. The second hose, i.e., the supply hose 520, as shown in FIG. 1, makes the water supply valve 400 communicate with the tub 200 via a path different from that of the water supply hose 510.

The water supply valve 400 supplies water to the tub 200 via two passages differing from each other in path, i.e., via the water supply hose 510 and the supply hose 520. In this case, the water supply valve 400 can simultaneously or individually control the first valve 410 and the second valve 420, by which a water supply to the tub 200 via the water supply hose 510 and a water supply to the tub 200 via the supply hose 520 can be simultaneously or individually performed.

The water supply hose 510, which makes the first valve 410 and the tub 200 communicate with each other, passes through a detergent box 50 as sown in FIG. 1. In this case, the water supply hose 510 is installed to directly penetrate the detergent box 50 or can be installed to communicate with a portion of the detergent box 50 5*o* be supplied with the detergent from the detergent box 50. Hence, the water introduced into the water supply hose 510 via the first valve 410 is always supplied to the tub 200 via the detergent box 50. The water having introduced into the tub 200 via the water supply hose 510 flows down along an inside of the tub 200 to be collected on a bottom of the tub 200. Meanwhile, the first valve 410 and the water supply hose 510 communicating with the detergent box 50, as shown in FIG. 1, can be plurally provided. If so, the detergent inputted for washing and the detergent for rinsing can be supplied to the tub 200 with a time difference, respectively.

The supply hose 520, as shown in FIG. 1, making the second valve 420 and the tub 200 communicate with each other detours the detergent box 50. Instead, the supply hose 520 passes through a tank 610. The tank 610 can store a predetermined amount of water therein or can make the stored water flood into the tub 200. Furthermore, the tank 610 can supply a prescribed amount of water stored therein to the tub 200 at one time. The supply hose 520 passing through the tank 610, as shown in FIG. 2, is connected to the nozzle assembly 60 provided to penetrate the gasket 25. Hence, the water introduced into the supply hose 520 via the second valve 420 is always supplied to the tub 200 via the tank 610.

Meanwhile, an enhanced washing effect can be achieved in case of performing washing with hot water instead of cold water. Hence, the washing machine according to the present invention includes a steam generator 600, as shown in FIG. 1 and FIG. 2, to enhance the washing effect by supplying hot steam to the tub 200. In order for the steam generator 600 to supply steam to the tub 200, the steam generator 600 needs a reservoir storing water supplied from the water supply source, a heater heating the water in the reservoir and a passage connecting the water supply source, the reservoir and the tub 200 together.

The washing machine according to the present invention includes the second hose, i.e., the supply hose 520 connecting the water supply valve 400 to the tub 200 and the tank 610 provided in the middle of the supply hose 520 to store water therein. Hence, to efficiently utilize the space within the washing machine and to reduce the number of parts, the tank 610 and the supply hose 520 are used as the parts of the steam generator 600.

The steam generator 600 uses the tank 610 and the supply hose 520 as the parts, can supply the water, which was received from the second valve 420, in liquid or steam phase to the tub 200 via the nozzle assembly 60.

Figure 3A:
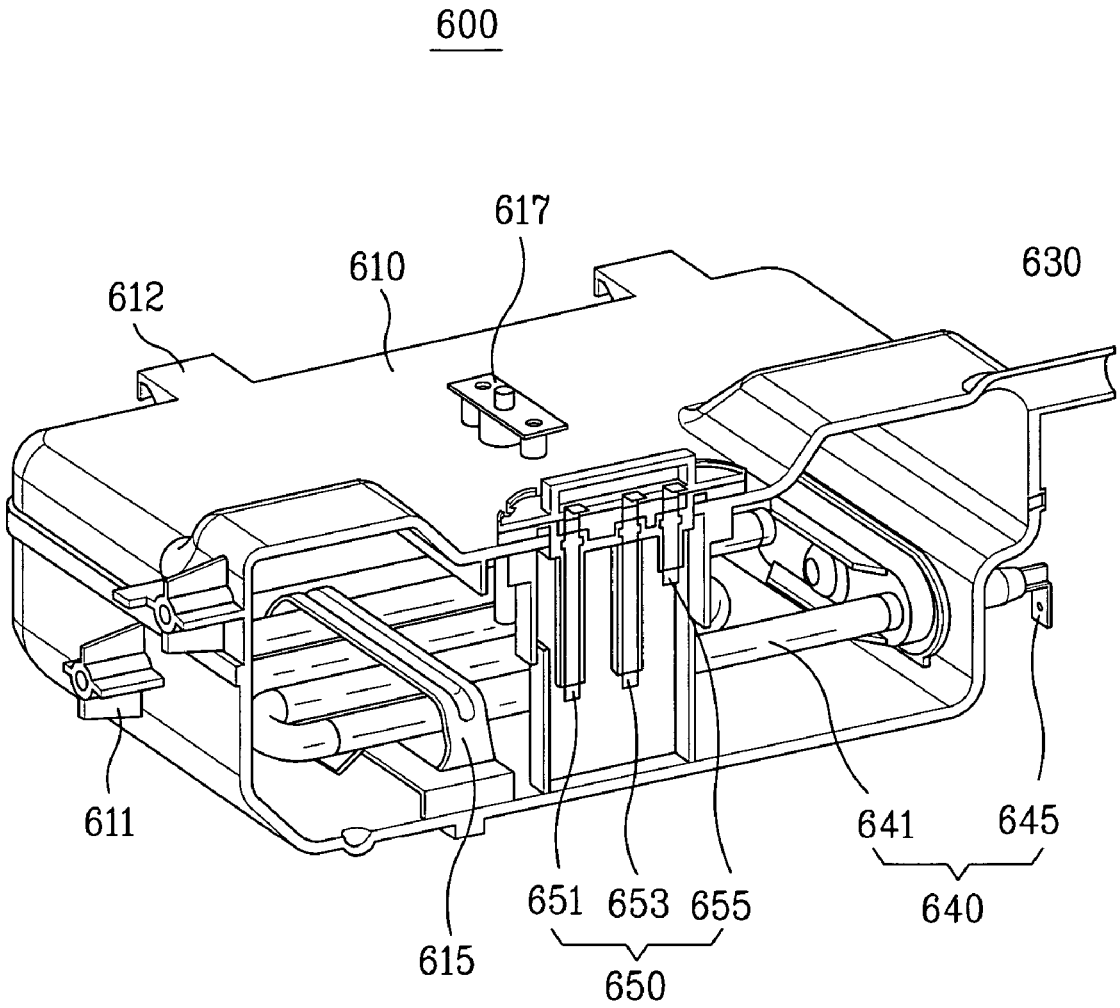
FIG. 3A is a perspective diagram of a steam generator of the washing machine in FIG. 1.
Figure 3B:
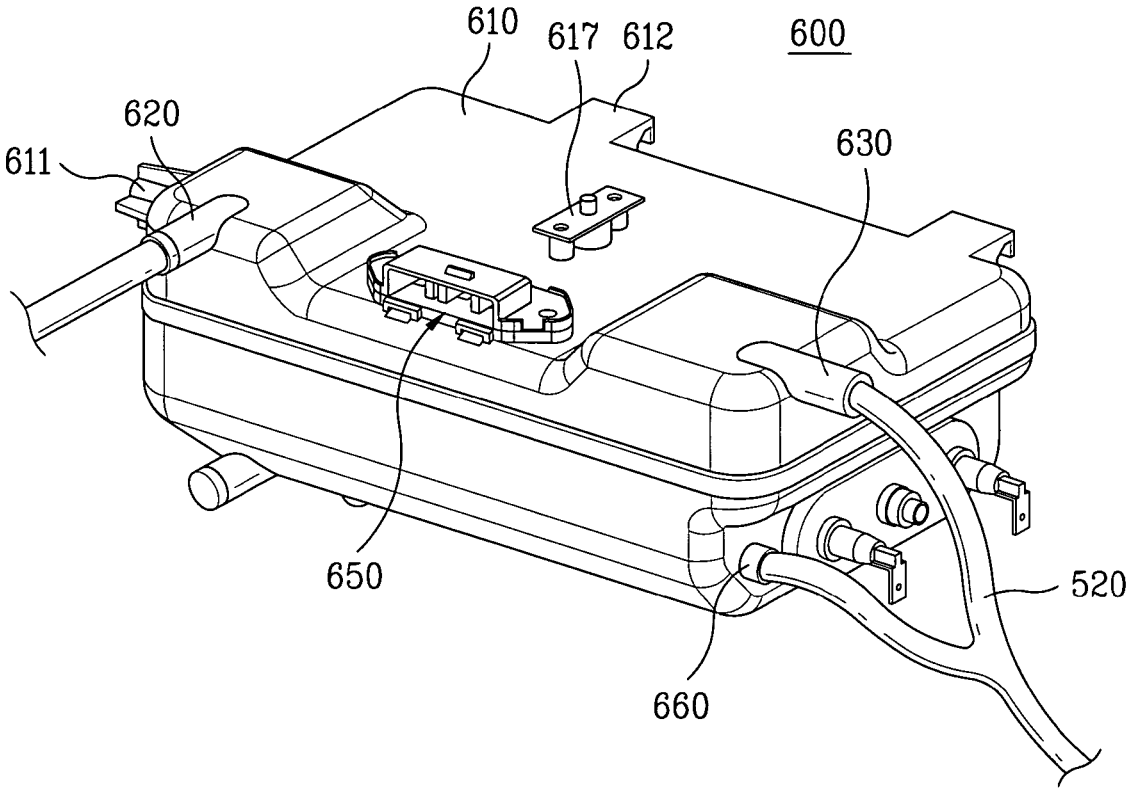
FIG. 3B is a perspective diagram of another example of a steam generator of the washing machine in FIG. 1.
Figure 5:
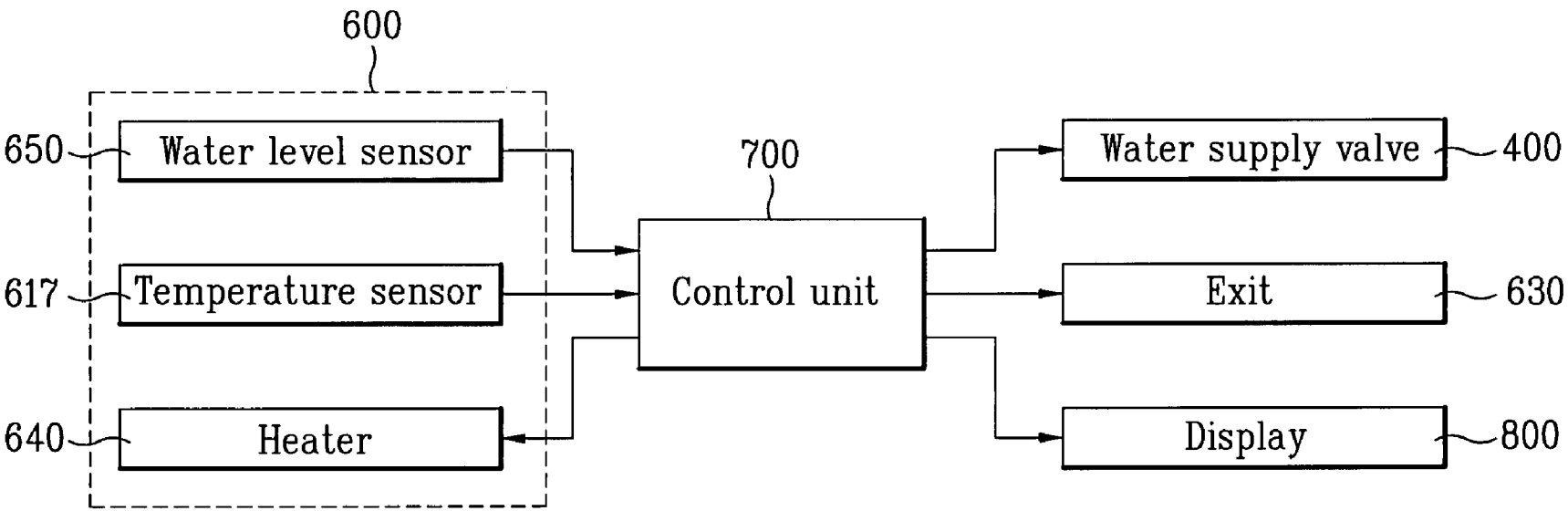
FIG. 5 is a block diagram of a configuration required for a water supply process of the present invention.

FIG. 3A is a perspective diagram of a steam generator of the washing machine in FIG. 1, FIG. 3B is a perspective diagram of another example of a steam generator of the washing machine in FIG. 1, and FIG. 5 is a block diagram of elements of a configuration required for a water supply process of the present invention. A configuration of the steam generator 600 is explained in detail with reference to the attached drawings as follows.

First of all, the steam generator 600, as shown in FIG. 3A, includes a tank 610 having an entrance 620 and an exit 630, a heater 640 provided to an inside bottom of the tank 610, a sensor assembly 650 detecting a water level within the tank 610, and at least one temperature sensor 617 sensing a temperature within the tank 610.

The tank 610 is provided with a space that can accommodate a predetermined amount of water therein. A projection 611 and an extension 612 are provided to an outside of the tank 610 to assemble the tank 610 to an inside of the case 100. And, the entrance 520 and the exit 630 are approximately provided to an upper part of the tank 610 for example. This is to prevent the water of the tank 610 from flowing backward to the second valve 420 via the entrance 20 and is to effectively discharge the steam generated within the tank 610 via the exit 630. The upper part, as shown in FIG. 1 and FIG. 3A, of the tank 610, where the entrance 620 and the exit 630 are formed, are configured to locally protrude.

The entrance 620 communicates with the second valve 420 via the water supply hose 520 and the exit 630 communicates with the nozzle assembly 60 via the supply hose 520. Meanwhile, a separate on/off valve is not provided to each of the entrance and exit 620 and 630. Hence, the entrance 20 and the exit 630 can perform functions opposite to each other. For instance, the entrance 620 and the exit 630 can be used as a new exit and a new entrance, respectively. If so, in case that a location of the tank 610 needs to be changed within the case 100, the entrance 620 and the exit 630 can be compatibly used. By such a compatibility between the entrance 620 and the exit 630, the tank 610 becomes compatible to different models in producing various models. Yet, the on/off valves can be provided to the exit 630 and the entrance 620, respectively if necessary.

The heater 640 includes a heat-generating unit and a terminal 645. The heat-generating unit 641 of the heater 640, as shown in FIG. 3A, is evenly installed on an inner bottom surface of the tank 610. And, the terminal 645 of the heater 645 penetrates a lateral side of the tank 610 to be externally exposed. Meanwhile, one of the heat-generating unit 641 is supported by a clamp 615 provided to the bottom surface of the tank 610 to be spaced from the bottom surface of the tank 610 with a prescribed distance.

The sensor assembly 650 includes a plurality of electrodes that sense minimum and maximum water levels within the tank 610. In this case, the minimum water level is to prevent the heat-generating unit 641 of the heater 640 from being overheated and is determined to be slightly higher than an upper end of the heat-generating unit 641. And, the maximum water level is determined to prevent the water introduced into the tank 610 from blooding via the exit 630 and is determined to be slightly lower than the exit 630.

The sensor assembly 650 for sensing the minimum and maximum water levels, as sown in FIG. 3A, includes a common electrode 651, a first electrode 653 and a second electrode 655. The common, first and second electrodes 651, 652 and 653 are vertically arranged to be spaced from one another. And, upper ends of the common, first and second electrodes 651, 652 and 653 are installed to penetrate an upper side of the tank 610. And, terminals are provided to the upper ends of the common, first and second electrodes 651, 652 and 653 penetrating the tank 610 to be externally exposed, respectively.

The common and first electrodes 651 and 653, as shown in FIG. 3A, are formed long and lower ends of the common and first electrodes 641 and 653 are substantially equal to each other in height. Hence, the common and first electrodes 651 and 653 are simultaneously submerged under the water or are simultaneously exposed from the water, substantially. If the common and first electrodes 651 and 653 are simultaneously submerged under the water, the common and first electrodes 651 and 653 are electrically connected together. Hence, a control unit 700 including a microprocessor and the like decides that a water level within the tank 610 is equal to or higher than the minimum water level.

In contrast, if the water level within the tank 610 is lowered to expose both of the common electrode 651 and the first electrode 653, the common electrode 651 and the first electrode 653 are electrically disconnected from each other so that the control unit 700 decides that the water level within the tank 610 is equal to or lower than the minimum water level. Thus, if the water level within the tank 610 is lowered to the minimum water level or below, the control unit 700 stops driving the heater 640 to prevent the heater 640 from being broken by overheat.

A length of the second electrode 65 is smaller than that of the common electrode 651 or the first electrode 653. Hence, a lower end of the second electrode 655 is located higher than that of the common electrode 651 or the first electrode 653. If the second electrode 655 is not submerged under the water due to the low water level within the tank 610, the electrical disconnection between the common electrode 651 and the first electrode 653 is maintained. Hence, the control unit 700 decides that the water level within the tank 610 does not reach the maximum water level.

On the other hand, if the second electrode 655 is submerged under the water due to a rise of the water level within the tank 610, the common electrode 651, the first electrode 653 and the second electrode 655 are electrically connected together. Hence, the control unit 700 decides that the water level within the tank 610 corresponds to the maximum water level. If the water level within the tank 610 reaches the maximum water level, the control unit 700 closes the second valve 420 to prevent the water from being further supplied to the tank 610 in case of generating the steam from the steam generator 600. Yet, in case that the water is supplied to the tub 200 via the steam generator 600, the control unit 700 does not close the second valve 420 even if the sensor assembly detects the maximum water level. Hence, the water keeps being supplied to the tank 610 and eventually floods into the tub 200 from the tank 610 via the exit 630.

A process of generating the steam from the above configured steam generator 600 is explained as follows.

First of all, the control unit 700 measures the water level within the tank 610 using the sensor assembly 650. If the water level within the tank 610 is low, the control unit 700 opens the second valve 420 to supply the water to the tank 610. Yet, if the maximum water level is detected by the sensor assembly 650, the control unit 700 closes the second valve 420 to stop supplying the water to the tank 610.

Once the tank 610 is filled up with the water, the heater 640 is driven to heat the water within the tank 610. Once the water is heated, the steam is generated. The generated steam is then sprayed into the tub 200 via the exit 600. As the steam keeps being supplied to the tub 200, the water level within the tank 610 keeps being lowered. If the water level within the tank 610 reaches the minimum water level according to the evaporation of the water within the tank 610, the control unit 700 turns off the heater 640. And, if necessary, after water is supplied to the tank 610, the heater 640 is driven to supply steam to the tub 200 again.

In the above description, the water is supplied to the tub 200 in a manner of flooding into the tub 200 from the tank 610 via the exit 630. Yet, the present invention is not limited to the above manner.

For another example of configuration, if the tank 610 is filled up with water to its maximum water level, the water stored within the tank 610 can be supplied to the tub 200 all together. For this, a second exit 660, as shown in FIG. 3B, is provided to a lower part of the tank 610 to turned on/off. In this case, the second exit 660 is connected to the supply hose 520 connected to the tub 200. The second exit 660 is normally closed. The second exit 660 is selectively turned on only in case of intending to supply the water to the tub 200 by measuring a quantity of the water. IF the second exit 660 is selectively turned on, the water stored within the tank 610 is supplied to the tub all together.

Meanwhile, a drain 210, as shown in FIG. 2, is provided to a lower side of the tub 200. And, a drain bellows tube 33 is connected to the drain 210. A pump unit is connected to the drain bellows tube 33. In this case, the pump unit discharges water externally by pumping the water introduced via the drain 210 and the drain bellows tube 33 or circulates the water into the drum 300.

The pump unit, as shown in FIG. 1, includes a pump housing 45, a circulation pump 30 and a drain pump 40. The water is introduced into the pump housing via the drain 210 and the drain bellows tube 33. A drain hose 37 is connected to the drain pump 40 to communicate with an external environment. The drain pump 40 discharges the water, which was introduced into the pump housing 45 on a drain cycle of the washing machine, to the external environment via the drain hose 37.

A circulation hose 35 is connected to the circulation pump 30. And, one end of the circulation hose 35, as shown in FIG. 2, is connected to the nozzle assembly 60 installed to penetrate the gasket 25. The circulation pump 30 pumps the water, which was introduced into the pump housing 45 in performing a washing or rinsing cycle of the washing machine, to the circulation hose 35. And, the pumped water is sprayed into the tub 200 via the nozzle assembly 60.

Figure 4:
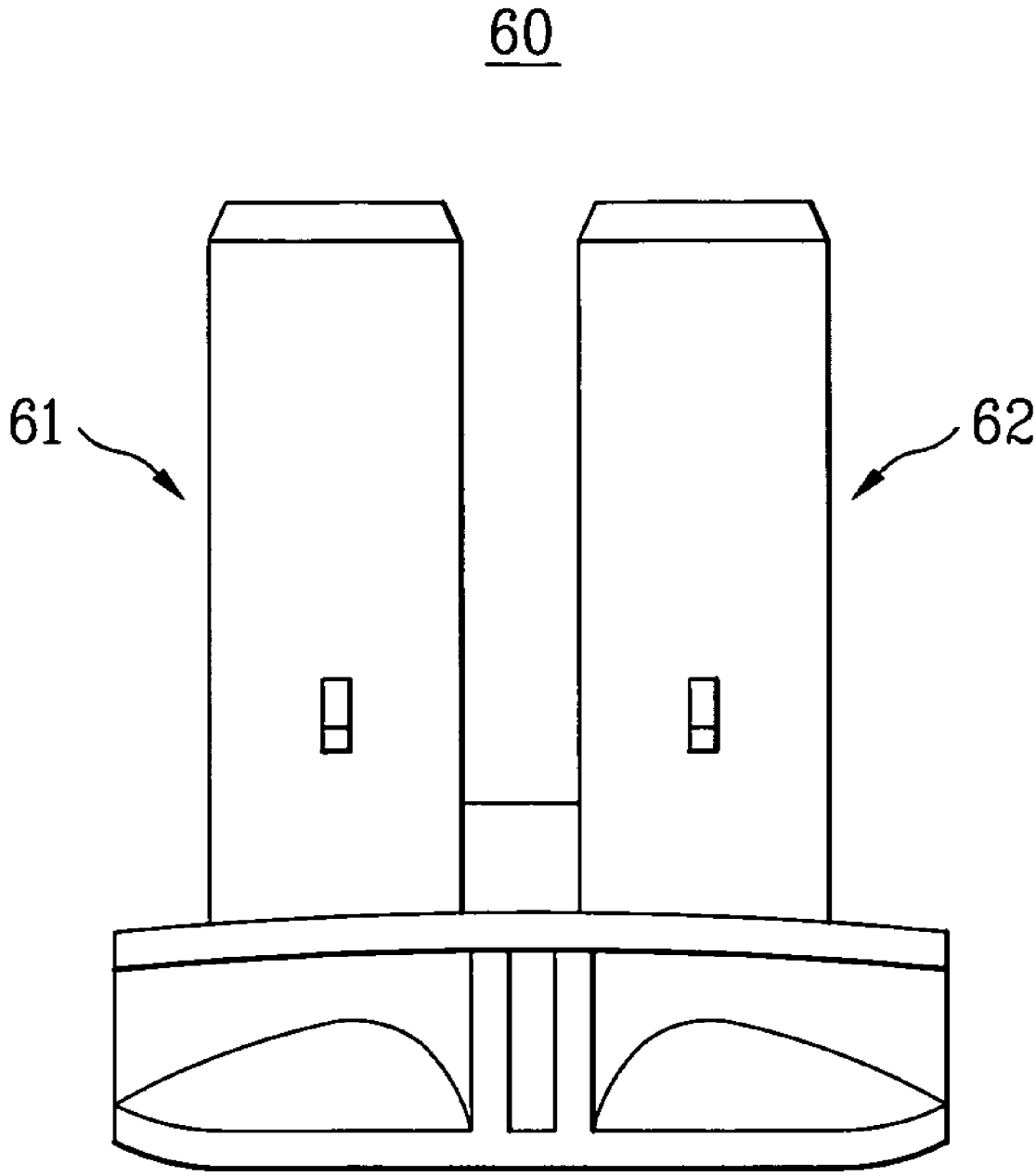
FIG. 4 is a diagram of a nozzle assembly connected to a water supply hose and a supply hose.

As explained in the foregoing description, the circulation hose 35 and the supply hose 520 are connected to the nozzle assembly 60 installed to penetrate the gasket 25. The nozzle assembly 60, as shown in FIG. 4, includes a first nozzle 61 connected to the circulation hose 35 to spray the water pumped by the circulation pump 30 into the tub 200 and a second nozzle 62 connected to the supply hose 520 to spray the steam generated from the steam generator 600 or the water having passed through the steam generator 600 into the tub 200. The first and second nozzles 61 and 62, as shown in FIG. 3A, are arranged parallel to each other and are built in one body to facilitate their fabrication and installation.

Meanwhile, in the present invention, the water is supplied to the tub 200 through the supply hose 520 detouring the detergent box 600 as well as through the water supply hose 510 via the detergent box 600. Hence, it is able to supply more water to the tub 200 within a time shorter than that of the related art washing machine that supplies water through the water supply hose 510 only, whereby a washing or rinsing time can be reduced.

Water supply methods according to embodiments of the present invention are explained in detail with reference to the attached drawings as follows.

First Embodiment

Figure 6:
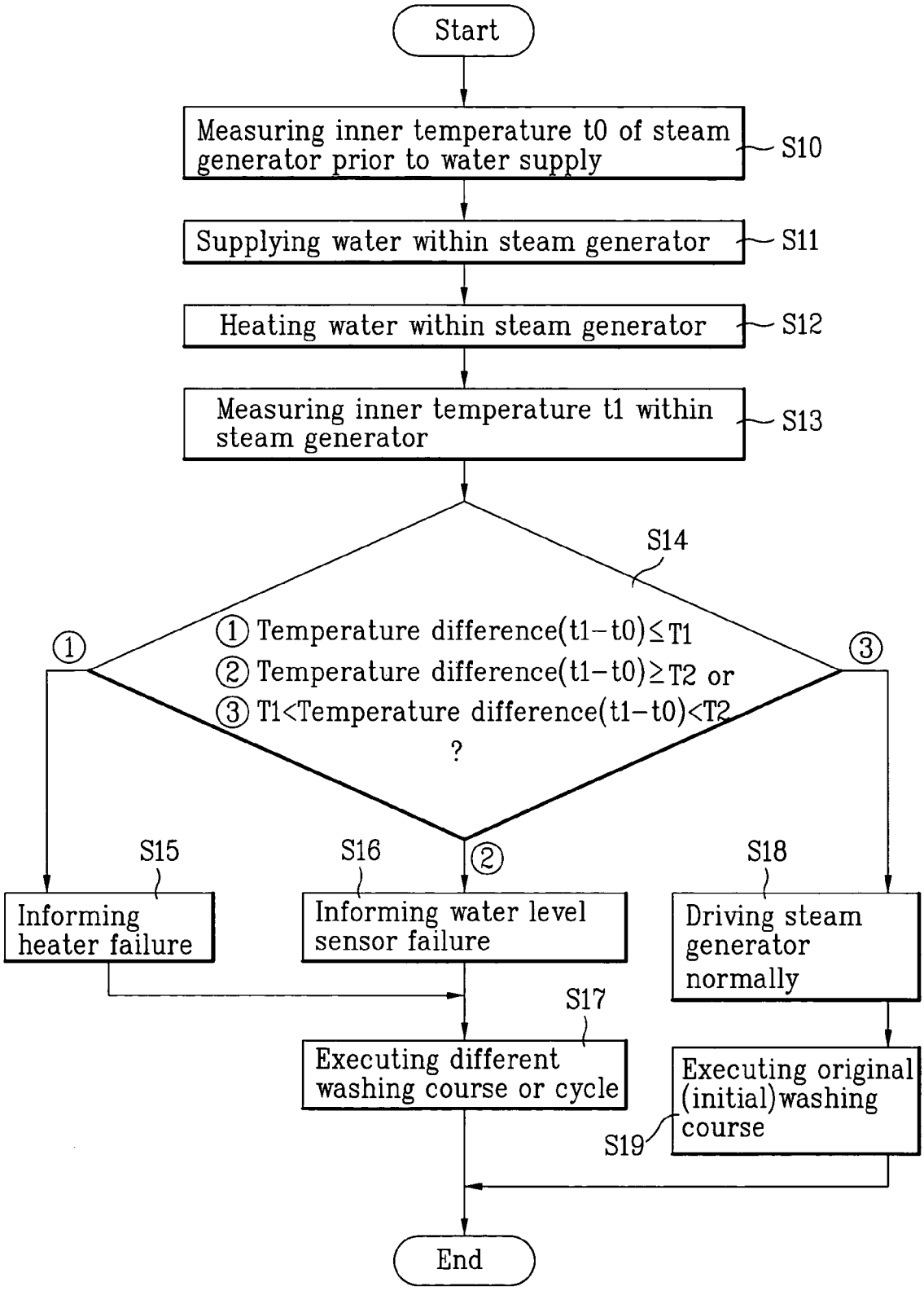
FIG. 6 is a flowchart of a water supply method according to a first embodiment of the present invention.

FIG. 6 is a flowchart of a water supply method according to a first embodiment of the present invention.

Referring to FIG. 6, once a washing or rinsing cycle is selected and initiated, the temperature sensor 617 measures an inner temperature t0 of the steam generator 600 according to a command of the control unit 700 (S10). In doing so, it is preferable that a temperature of an air within the steam generator 600 is measured. Alternatively, it is also possible to measure a temperature of water in case that a small quantity of the water remains within the steam generator 600.

Subsequently, a predetermined quantity of water is supplied to the tub 200. For this, the control unit 700 turns on the first valve 410 to supply water of the water supply source to the tub 200 via the water supply hose 510. The water supply hose 510, as mentioned in the foregoing description, passes through the detergent box 600. Hence, in case that the detergent box 600 is supplied with the detergent, the detergent can be supplied to the tub 200 together with the water introduced into the water supply hose 510. The water supplied to the tub 200 via the water supply hose 510 flows down along an inside of the tub 200 to be collected on the bottom of the tub 200. After a duration, the water level within the tub 200 is gradually raised.

Simultaneously, the control unit 700 turns on the second valve 420 to supply water to the steam generator 600 (S11). The supply hose 520 passes through the steam generator 600 instead of detouring the detergent box 600. Hence, the water having been introduced into the supply hose 520 is introduced into the tank 610. After a duration, the tank 610 is filed up with the water.

If the sensor assembly 650 detects the maximum water level, the control unit 700 turns off the second valve 420. And, the control unit 700 turns on the heater 640 during a set time, e.g., during 1~100 seconds to heat the water within the tank 610 (S12). Once the water within the tank 610 is boiled, the steam is generated to raise a pressure within the tank 610. After expiration of the set time, the control unit 700 turns off the heater 640. Right after the heater 640 has been turned off or after a predetermined duration, the control unit 700 allows the temperature sensor 617 to measure a temperature t1 of the heated water within the tank 610 (S13).

The control unit 700 calculates a difference between the measured temperatures t1 and t0, decides a presence or non-presence of abnormality of the stream generator 600 according to the calculated temperature difference (t1−t0), and then executes a washing or rinsing cycle (S14).

For instance, the control unit 700 compares the calculated temperature difference (t1−t0) to a reference temperatures T1 or T2. If the calculated temperature difference (t1−t0) is smaller than a minimum temperature limit T1, the control unit 700 decides that there occurs an error or malfunction of the heater 640 and then outputs a message or voice informing the error/malfunction of the heater 640 through a display or speaker 800 (S15). Subsequently, the control unit 700 automatically switches a function of the heater 640 to another washing course or cycle (e.g., a washing course or cycle using a function of a drum heating heater), which does not need the function of the heater 640, from the selected washing course or cycle (S17). Alternatively, the control unit 700 shows a message of inquiring whether to switch to a different washing course on the display and then executes a washing course re-selected by a user.

If the calculated temperature difference (t1−t0) is greater than a maximum temperature limit T2, the control unit decides that there occurs an error/malfunction of the water level sensor 650 or the temperature sensor 617. This is because, if the air within the tank 610 is overheated or if the temperature sensor 617 is abnormal, the calculated temperature difference (t1−t0) is greater than the maximum temperature limit T2. If the water level sensor 650 or the temperature sensor 617 is decided abnormal, the control unit 700 outputs a message or voice informing the error/malfunction of the water level sensor 650 or the temperature sensor 617 through the display or speaker 800 (S16). Subsequently, the control unit 700 automatically switches a function of the heater 640 to another washing course or cycle (e.g., a washing course or cycle using a function of a drum heating heater), which does not need the function of the water level sensor 650 or the temperature sensor 617, from the selected washing course or cycle (S17). Alternatively, the control unit 700 shows a message of inquiring whether to switch to a different washing course on the display and then executes a washing course re-selected by a user.

If the calculated temperature difference (t1−t0) is grater than the minimum temperature limit T1 and is smaller than the maximum temperature limit T2, the control unit 700 normally drives the steam generator 600 (S18) and keeps executing the initially selected washing or rinsing cycle (S19).

Second Embodiment

Figure 7:
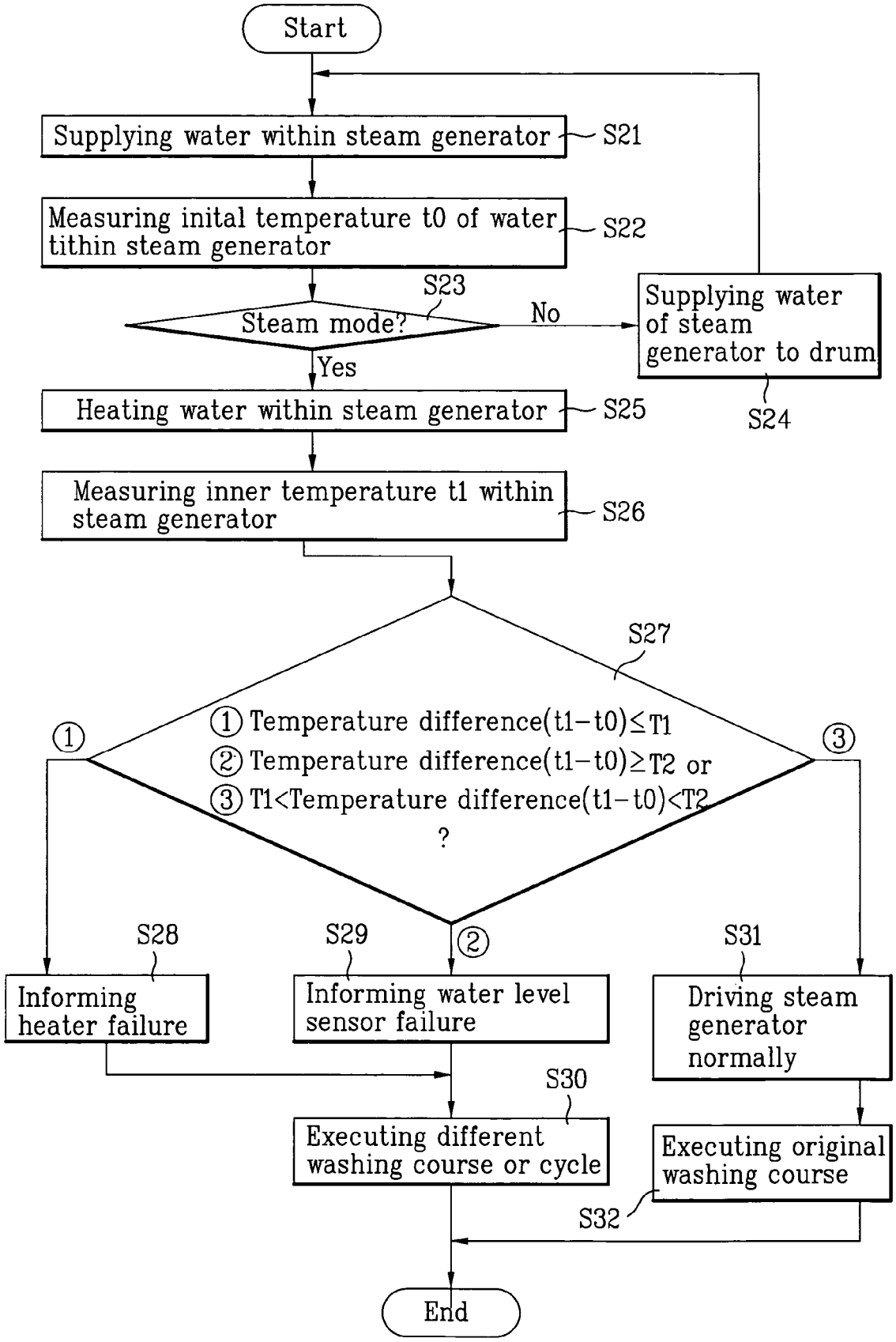
FIG. 7 is a flowchart of a water supply method according to a first embodiment of the present invention.

FIG. 7 is a flowchart of a water supply method according to a first embodiment of the present invention.

Referring to FIG. 7, once a washing course or cycle is selected, the control unit 700 turns on the first valve 410 to supply water to the tub 200 and also turns on the second valve 420 to supply water to the tank 610 (S21).

A user can previously select either a steam mode for using steam or a non-steam mode for not using steam. Alternatively, the control unit 700 can automatically select either the steam mode or the non-steam mode. The control unit 700 measures a temperature t0 of water introduced into the tank 610 using the temperature sensor 617 (S22) and then selects either the steam mode or the non-steam mode based on the measured water temperature (S23). For instance, if the temperature of the water introduced into the tank 610 is lower than a set temperature, the control unit 700 selects the steam mode. If the temperature of the water introduced into the tank 610 is greater than the set temperature, the control unit 700 selects the non-steam mode.

In case that the non-steam mode is selected, the control unit 700 does not turn off the second valve 420 even if the sensor assembly 650 detects the maximum water level. Hence, the water fully filling up the tank 610 of the steam generator 600 overflows from the steam generator 600 via the exit 630 provided to the upper part of the tank 610. The water having overflown from the tank 610 of the steam generator 600 is supplied to the tub 200 via the supply hose 520 and the nozzle assembly 60 (S24). In doing so, the water having passed through the supply hose 520 is evenly sprayed into the tub 200 via the second nozzle 62 provided to an upper inside of the tub 200. And, the laundry accommodated within the drum 300 can be evenly soaked in the water having sprayed into the tub 200. Hence, it is able to shorten the time for soaking the laundry prior to a main washing step on water supply for washing. And, it is able to wash out detergent sediment from a surface of the laundry in supplying water for rinsing.

In case that the steam mode is selected, the control unit 700 turns off the second valve 420 if the sensor assembly 650 detects the maximum water level. To heat the water within the tank 610, the control unit 700 turns on the heater for a set time, e.g., for 1~100 seconds (S25). Once the water within the tank 610 is boiled to generate steam, a pressure within the tank 610 is raised. After expiration of the set time, the control unit 700 turns off the heater 640 and then allows the temperature sensor 617 to measure a temperature t1 of the heated water within the tank 610 right after turning of the heater 640 or after a predetermined duration (S26). Subsequently, the control unit calculates a difference between the measured temperatures t1 and t0, decides a presence or non-presence of abnormality of the steam generator 600 according to the calculated temperature difference (t1−t0), and then changes a washing course or cycle (S27). And, the following steps S28 to S32 are equal to those of the first embodiment of the present invention.

The above-described water supply process according to the present invention is applicable to a laundry wetting or soaking cycle as well as to the washing or rinsing cycle.

Accordingly, since the laundry gets wet using the steam, the present invention enables the washing with a small quantity of water.

And, the steam raises the temperature within the drum and the water temperature, whereby washing efficiency can be raised.

Moreover, by deciding the presence or non-presence of the abnormality of the steam generator, the washing course or cycle can be automatically changed.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of controlling a laundry machine comprising a rotatable drum in which laundry is placed, comprising:

detecting a first temperature of a steam generator, the steam generator configured to generate steam to be supplied to the drum;

keeping a heater of the steam generator on for a set time;

detecting a second inside temperature of the steam generator; and deciding based on the sensed temperatures whether the steam generator is in an abnormal state.

2. The method of claim 1, wherein the decision is made based on a comparison of a temperature difference between the sensed temperatures and one or more preset values.

3. The method of claim 2, wherein if the temperature difference is smaller than a minimum preset value or greater than a maximum preset value, it is decided that the steam generator is in an abnormal state.

4. The method of claim 2, wherein if the temperature difference is greater than a minimum preset value and smaller than a maximum preset value, it is decided that the steam generator is in a normal state.

5. The method of claim 1, further comprising a step of outputting a message or an alarming sound to notify a user that the steam generator is in an abnormal state.

6. The method of claim 1, further comprising a step of changing a course or cycle if it is decided that the steam generator is in an abnormal state.

7. The method of claim 6, wherein the change is made as a user commands.

8. The method of claim 6, wherein the change is made automatically to a preset course or cycle.

9. The method of claim 1, wherein the temperatures are water temperatures of the steam generator.

10. The method of claim 1, further comprising supplying steam from the steam generator to the drum.

11. A laundry machine comprising:

a drum rotatably mounted in the laundry machine;

a steam generator to generate and provide steam to the drum, the steam generator having a heater heating water in the steam generator and a temperature sensor detecting an first temperature and a second temperature of the steam generator, wherein the second temperature is detected after the heater is kept on for a set time; and a control unit to decide based on a difference between the sensed temperatures whether the steam generator is in an abnormal state, wherein the decision is made based on a comparison of the temperature difference between the sensed temperatures and one or more preset values.

12. The laundry machine of claim 11, wherein if the temperature difference is greater than a minimum preset value and smaller than a maximum preset value, the control unit decides that the steam generator is in a normal state.

13. The laundry machine of claim 11, wherein if the temperature difference is smaller than a minimum preset value or greater than a maximum preset value, the control unit decides that the steam generator is in an abnormal state.

14. The laundry machine of claim 11, wherein the control unit selects either a steam mode for using the steam or a non-steam mode for not using the steam according to an initial temperature of the steam generator.

15. The laundry machine of claim 11, wherein the temperatures are water temperatures of the steam generator.

* * * * *